US007082878B2

(12) United States Patent
Facciano et al.

(10) Patent No.: US 7,082,878 B2
(45) Date of Patent: Aug. 1, 2006

(54) MISSILE WITH MULTIPLE NOSECONES

(75) Inventors: Andrew B. Facciano, Oro Valley, AZ (US); Robert T. Moore, Tucson, AZ (US); James E. Parry, Suhuarita, AZ (US); John Terry White, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/715,176

(22) Filed: Nov. 17, 2003

(65) Prior Publication Data

US 2005/0000383 A1 Jan. 6, 2005

Related U.S. Application Data

(60) Provisional application No. 60/484,197, filed on Jul. 1, 2003.

(51) Int. Cl.
*F42B 15/00* (2006.01)

(52) U.S. Cl. ..... 102/377

(58) Field of Classification Search ..... 102/377, 102/703; D12/319, 345
See application file for complete search history.

(56) References Cited

U.S. PATENT DOCUMENTS 3,161,132 A * 12/1964 Siebert et al. ..... 102/374
3,485,460 A 12/1969 Mertens
3,601,055 A * 8/1971 Crockett ..... 102/377
3,960,626 A * 6/1976 Casadevall ..... 156/93
3,970,006 A * 7/1976 Copeland et al. ..... 89/1.14
4,038,776 A * 8/1977 Filipeli ..... 446/52
4,498,394 A * 2/1985 Regebro ..... 102/489
4,638,737 A * 1/1987 McIngvale ..... 102/489
4,798,143 A * 1/1989 Graham ..... 102/370
4,867,357 A * 9/1989 Inglis et al. ..... 244/121
4,949,920 A * 8/1990 Schindel et al. ..... 244/117 A (Continued)

OTHER PUBLICATIONS

Facciano, et al. *High Temperature, Hybrid Composite Airframe Components for Tactical Ballistic Missile Interceptors*. Presented at 50th JANNAF Propulsion Conference, Salt Lake City, Utah, Jul. 11-12, 2001.

Facciano, et al. *Advanced Endo-Atmospheric, Kinetic Kill Vehicle (KKV) Airframe Weight and Cost Optimization Study for Enhanced Seeker Dynamics Performance*. Presented at National Space & Missile Materials Symposium, Colorado Springs, Colorado, Jul. 24-28, 2002.

*Primary Examiner*—Michael Carone
*Assistant Examiner*—Bret Hayes
(74) *Attorney, Agent, or Firm*—Renner, Otto, Boisselle & Sklar, LLP

(57) ABSTRACT

A missile includes a payload assembly that has a pair of nosecones. The nosecones may be optimized for different environments and/or phases of flight, for example, having different shapes, different shell materials, different types of seals, and/or different separation mechanisms. The first (outer) nosecone may have a more streamlined shape, be made of more thermally-protective material, and may meet less stringent sealing requirements, than the second (inner) nosecone. Separation of the outer nosecone from the payload assembly may cause backward movement of a center of pressure of the payload assembly, bringing the center of pressure of the assembly closer to a center of gravity of the assembly. This may make the payload assembly easier to maneuver, for example, reducing or eliminating the need for intervention by an attitude control system, to maintain the payload assembly on a desired course.

33 Claims, 11 Drawing Sheets

U.S. PATENT DOCUMENTS 5,159,151 A * 10/1992 Dransfield et al. ..... 102/293
5,494,239 A * 2/1996 Giacomel ..... 244/3.1
5,824,404 A 10/1998 Brown et al.
5,979,826 A 11/1999 Brown et al.
6,142,424 A 11/2000 Wagner et al.
6,622,971 B1 9/2003 Robertson

* cited by examiner

MISSILE WITH MULTIPLE NOSECONES

This application claims priority under 35 USC 119(e) from U.S. Provisional Application No. 60/484,197, filed Jul. 1, 2003, which is incorporated herein by reference in its entirety.

BACKGROUND OF THE INVENTION

1. Technical Field

The invention relates to missiles and missile systems.

2. Background of the Realted Art

Previous missile interceptor designs have relied in high altitude flight (HAF) on stability mechanisms of highly dubious reliability, crippling performance constraints, and crushing cost penalties. The previous approaches to stabilizing missiles in HAF include large aerodynamic flares mounted aft that first axially telescoped aft and then deployed radially after second stage separation, large-span folding aero-fins mounted onto a third stage aft airframe that again deployed after second stage separation, and four electro-mechanical canards mounted onto the prior art nosecone. All these aero-stabilizing mechanisms are costly, heavy, complicated to the point that successful operation was questioned, and significantly degrade the kinematic performance of the interceptor. Other more passive options proposed included nosecone aero-spikes, enlarging the current third stage airframe flare to mate with a larger diameter booster, and shifting the interceptor center of gravity with ballast. None of these passive control ideas has proven successful. Accordingly, it will be appreciated that improvements in missile design would be desirable.

SUMMARY OF THE INVENTION

According to an aspect of the invention, a missile includes a payload assembly; and one or more booster stages separably coupled to the payload assembly. The payload assembly includes at least two nosecones.

According to another aspect of the invention, a method of operating a missile during flight includes the steps of: exposing to atmosphere, during a first phase of the flight, an outer nosecone of a payload assembly of the missile; separating the outer nosecone from the payload assembly following the first phase of the flight, thereby exposing an inner nosecone of the payload assembly; and continuing flight of the missile during a second phase of the flight.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A missile includes a payload assembly that has a pair of nosecones. The nosecones may be optimized for different environments and/or phases of flight, for example, having different shapes, different shell materials, different types of seals, and/or different separation mechanisms. The first (outer) nosecone may have a more streamlined shape, be made of more thermally-protective material, and may meet less stringent sealing requirements, than the second (inner) nosecone. Separation of the outer nosecone from the payload assembly may cause backward movement of a center of pressure of the payload assembly, bringing the center of pressure of the assembly closer to a center of gravity of the assembly. This may make the payload assembly easier to maneuver, for example, reducing or eliminating the need for intervention by an attitude control system, to maintain the payload assembly on a desired course.

Figure 1:
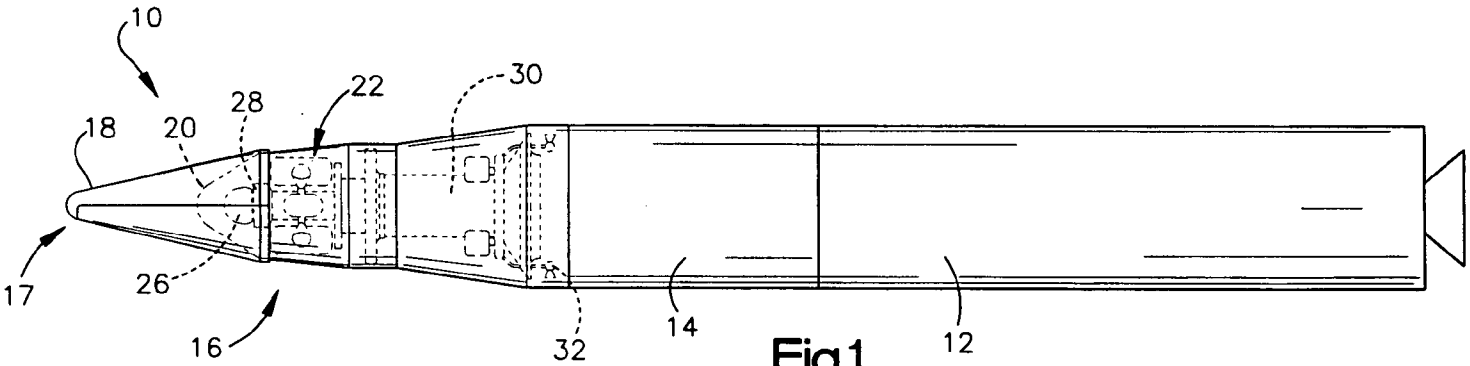
FIG. 1 is a side view of a missile according to the present invention.

Referring initially to FIG. 1, a missile 10 includes a first stage 12, a second stage 14, and a payload assembly 16. The specific embodiment missile 10 shown in FIG. 1 and described herein is a maneuverable missile designed to impact a moving target, such as another missile, at a high altitude, for example, in excess of 90 km. However, it will be appreciated that a payload assembly, such as the payload assembly 16, having multiple nosecones, may be utilized with many other types of missiles.

The payload assembly 16 has a multi-nosecone assembly 17 that includes a pair of nosecones 18 and 20, both of which are detachable from a payload 22 of the payload assembly or third stage 16. As described in greater detail below, the first (outer) nosecone 18 is optimized for low-altitude flight, and the second (inner) nosecone 20 is optimized for higher-altitude flight.

As shown in FIG. 1, the payload 22 includes a sensor or seeker 26 for guidance of the missile 10, an impact projectile (also known as a kill vehicle) 28 for impacting and destroying an enemy missile, a third stage motor 30 for providing power for the payload assembly 16, and an attitude control system 32 for providing directional control for the payload assembly 16.

In basic operation, the first stage 12 and the second stage 14 of the missile 10 provide thrust to quickly accelerate the missile 10 from rest to a high speed. As the propellant of the first stage 12 and the second stage 14 are consumed, the stages 12 and 14 are jettisoned, thereby reducing parasitic weight carried by the missile 10. The payload assembly 16 then is maneuvered toward a target, such as an enemy missile. The third stage motor 30 and the attitude control system 32 provide power and course adjustment as the target is approached. Finally, the impact projectile 28 separates from the other components of the payload assembly 16 and ballistically flies toward and impacts the target. In this process the nosecones 18 and 20 separate away from the missile 10. The outer nosecone 18 separates after the primary boost has been provided by the stages 12 and 14. For example, the outer nosecone 18 may separate after the fuel of the second stage 14 has been substantially consumed, but before separation of the second stage 14. The inner nosecone 20 separates later in flight, after at least some of the fuel of the payload assembly 16 has been consumed by the third stage motor 30. The separation or detachment (also referred to as deployment) of the second nosecone 20 occurs prior to the separation of the impact projectile 28 from the rest of the payload 22. The separation of the second nosecone 20 may occur during a coasting portion of the flight of the assembly 16, between firings of the third stage motor 30. Alternatively, the inner nosecone 20 may separate after firing of the third stage motor 30 is substantially complete.

Figure 2:
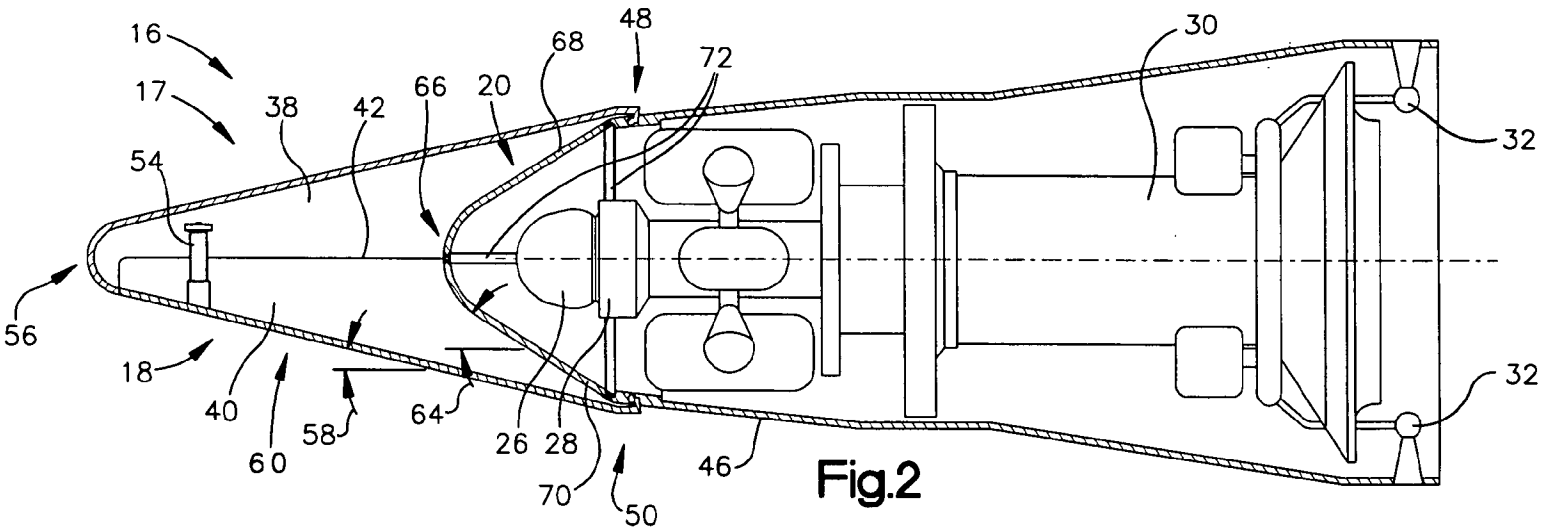
FIG. 2 is a cutaway side view of the payload assembly of the missile of FIG. 1.
Figure 3:
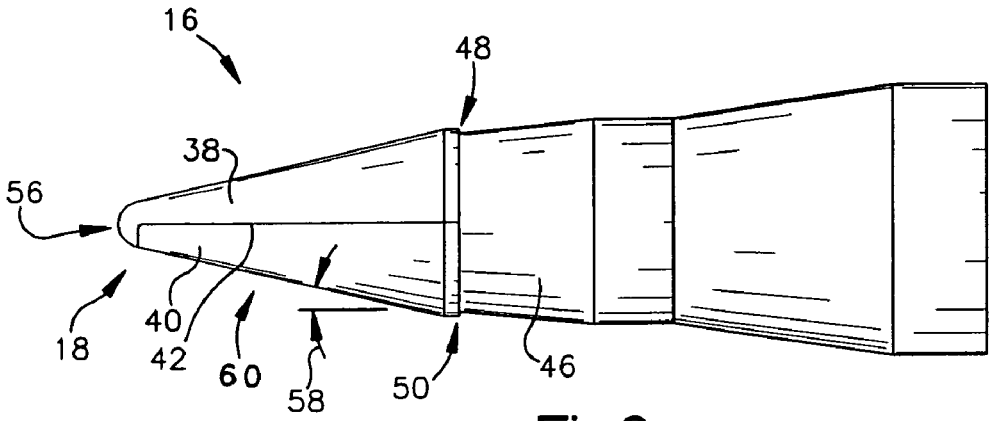
FIG. 3 is a side view of the payload assembly of the missile of FIG. 1.

Referring now to FIGS. 2 and 3, further details of the payload assembly 16 are shown. The outer nosecone 18 includes a pair of outer nosecone shell portions or petals 38 and 40. The petals 38 and 40 fit together along a seam seal 42. The seal 42 may be a tongue-and-groove gasket seal, as described in further detail below. The outer shell petals 38 and 40 are coupled to a housing 46 of the payload assembly 16, at hinge couplings 48 and 50 on opposite sides of the payload assembly 16. A pyrotechnic piston actuator 54 provides a way of separating the petals 38 and 40 from one another, and causing their deployment, separating and detaching them from the remainder of the payload assembly 16.

The outer nosecone 18 may be optimized for low-altitude flight, such as during the ascent through the relatively thick atmosphere close to the ground. Thus, the outer nosecone 18 may have a streamlined shape, for example, having a relatively sharp tip 56, and having a shape with a relatively small angle 58 in a conical portion 60 that is aft of the tip 56. The outer nosecone 18 thereby may have a lower coefficient of drag than the inner nosecone 20. In one embodiment, the tip 56 may be a hemispherical tip blunted to a radius of 3.6 inches (9.2 cm). The tip 56 may be blunted so as to move the stagnation point during hypersonic ascent, forward of the payload assembly 16. The outer nosecone angle 58 may be about 7 degrees. More broadly, the outer nosecone angle 58 may be between about 5 and about 10 degrees. Even more broadly, the outer nosecone angle 58 may be less than a corresponding inner nosecone angle 64 of the inner nosecone 20. Similarly, the outer nosecone tip 56 may be sharper than a corresponding inner nosecone tip 66 of the inner nosecone 20. Thus, the inner nosecone 20 may have a blunter shape, for example, with the inner tip 66 having a radius of about 6 inches (15 cm), and the inner nosecone angle 64 being about 40 degrees, or more broadly between about 30 and about 50 degrees.

The outer nosecone petals 38 and 40 may be formed of a high-strength composite material, and may include a thermal protection layer that ablates during the hypersonic ascent, prior to detachment of the outer nosecone 18. An example of a suitable thermal protection system material for the outer cone petals 38 and 40 is a composite material with a surface layer of silica. A suitable underlying material is a graphite-bismaleimide composite material. Such materials are described in commonly-assigned U.S. Pat. Nos. 5,824,404 and 5,979,826, the detailed descriptions and figures of which are incorporated herein by reference.

The inner nosecone 20 includes a pair of shell portions or petals 68 and 70. The petals 68 and 70 may be hermetically sealed one to another, and may be hermetically sealed to the housing 46 of the payload assembly 16, to prevent contaminants from reaching the components of the payload 22 enclosed within the payload assembly 16. A detonating charge 72 is arranged along suitable portions of the inner nosecone 20, so as to be able to separate the petals 68 and 70 one from another, and from the housing 46 of the nosecone 16. For example, the detonating charge 72 may be placed along the seam between the petals 68 and 70, and along the periphery of the inner nosecone 20, where the inner nosecone 20 joins the housing 46. The detonating charge 72 may be a well-known charge including an extruded aluminum tube riveted or braised on the inside of a groove that is attached to the inner nosecone 20. When the detonating charge 72 is exploded it expands and basically tears the aluminum or other material of the inner nosecone 20 apart.

The payload of the nosecone 16 includes the components described above with regard to FIG. 1: the sensor or seeker 26, the impact projectile or kill vehicle 28, the third stage rocket motor 30, and the attitude control system 32. The sensor or seeker 26 may be an optical or other device used in tracking movements of the target, to aid in correcting the course of the payload assembly 16 during flight. The seeker 26 may include an optical seeker. It will be appreciated that other types of seekers, such as microwave seekers, radar seekers, or lidar seekers, may alternatively be utilized.

The impact projectile 28 is used for impacting the target, and destroying the target and/or altering the course of the target. The impact projectile 28 may have a relatively large mass, so as to have a large kinetic energy during its hypersonic impact with the target.

The third stage rocket motor 30 provides propulsion for the payload assembly 16, after detachment of the first and second stages 12 and 14 from the missile 10. The third stage rocket motor 30 may be configured to provide intermittent thrust, that is, providing thrust at some times, while allowing the payload assembly 16 to coast at other times. For example, the third stage rocket motor 30 may be intermittently turned on for two to ten seconds before being turned back off for coasting operation.

The attitude control system (ACS) 32 provides a way of adjusting the course of the payload assembly 16. The ACS 32 may provide fully throttleable attitude control for directional stability and navigational control. The ACS 32 may be a plurality of small rocket motors, which may be located at various positions and orientations within the aft part of the payload assembly 16, and which may be selectively fired to achieve desired course fraction. It will be appreciated that a wide variety of other sorts of attitude control systems may alternatively be used, including systems that vary the orientation of a nozzle of the main rocket motor 30, and control surfaces that may be deployed to alter flight of the payload assembly 16.

It will be appreciated that the payload 22 may include other sorts of devices. For example, the payload 22 may include a control system for processing information from the sensor or seeker 26, and/or for controlling operation of the ACS 32. As another example, the payload 22 may include communication equipment for actively or passively communicating with a ground station or other device, for example, by use of radio waves or other energy waves, or by allowing target tracking, for example, via a radar beacon. For other types of missiles, it will be appreciated that the payload 22 may include a wide variety of other sorts of payload.

As noted above, the nosecones 18 and 20 may have different designs, based on the different environments for which they are utilized. The outer nosecone 18 may be used in a near-earth, standard-atmosphere environment, for example, up to about 50 km. In such an environment air density is at its highest, making drag and heat build-up a significant concern, especially for a missile traveling at high (such as hypersonic) speeds. Therefore, the outer nosecone 18 may have a streamlined shape, and may be made of a material able to withstand the high amounts of heat build-up during high-speed flight within the atmosphere. Once the missile 10 has moved out of the near-earth atmosphere the streamlining and high-thermal protection of the outer nosecone 18 are no longer necessary, and in fact may even be a hindrance, due to its parasitic weight and undesirable effect on the center of pressure of the missile 10.

As noted above, the inner nosecone 20 may have high sealing requirements, for example, being hermetically sealed, in order to protect the payload 22 from undesired contamination. Sealing in the inner nosecone 20 may be accomplished by use of a polysulfide sealant sealing a metallic interface, between the petals 68 and 70 of the inner nosecone 20, and between the inner nosecone 20 and the housing 46.

Sealing requirements for the outer nosecone 18 may be less stringent. This may be at least in part because of the hermetical seal provided by the inner nosecone 20, and because there may be no critical equipment located between the outer nosecone 18 and the inner nosecone 20. The main sealing requirements of the outer nosecone 18 may be to avoid ingress of hot jets of gas as is often a concern during supersonic or hypersonic flight in near-earth atmosphere. Thus, a gasketed tongue-and-groove seal between the petals 38 and 40 of the outer nosecone 18 may be sufficient.

Since the inner nosecone 20 operates in a less dense atmosphere, less streamlining is required, and a much lighter thermal protection system may be used for the inner nosecone 20. The inner nosecone 20 may include any of a variety of suitable thermal protection materials such as phenolic nylon, carbon phenolic, or quartz phenolic.

Figure 4:
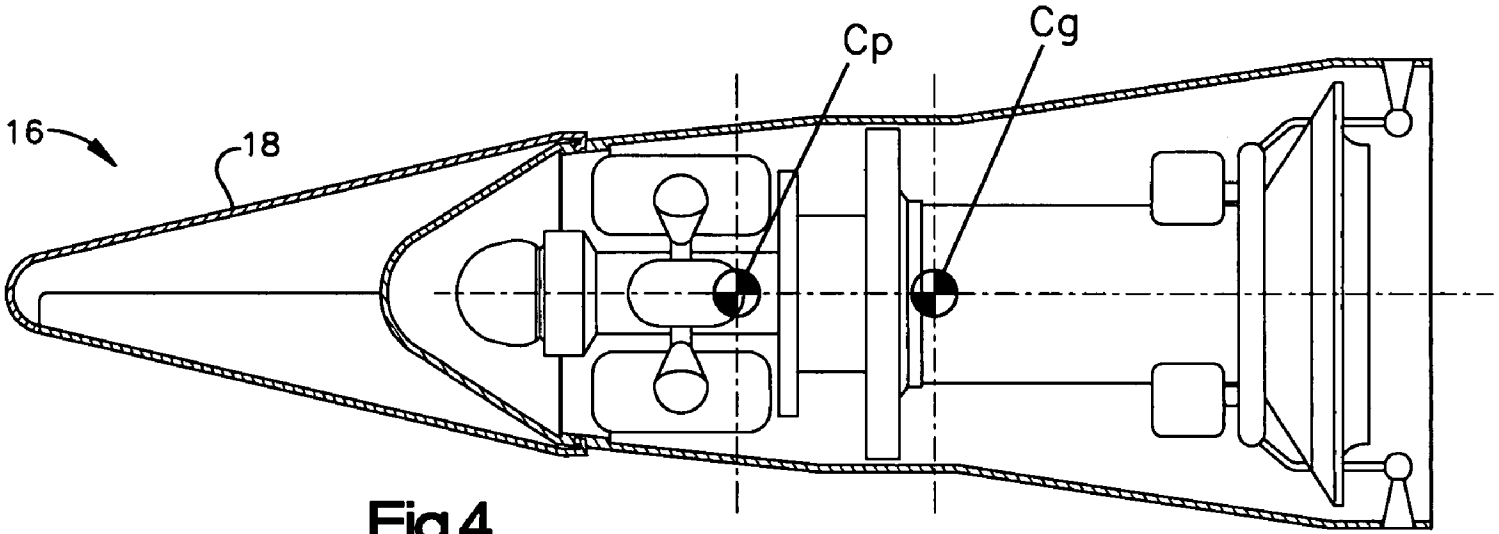
FIGS. 4 and 5 are side views of the payload assembly of the missile of FIG. 1, showing the relative placement of the center of pressure ($C_p$) and the center of gravity ($C_g$) with and without the outer nosecone attached.
Figure 5:
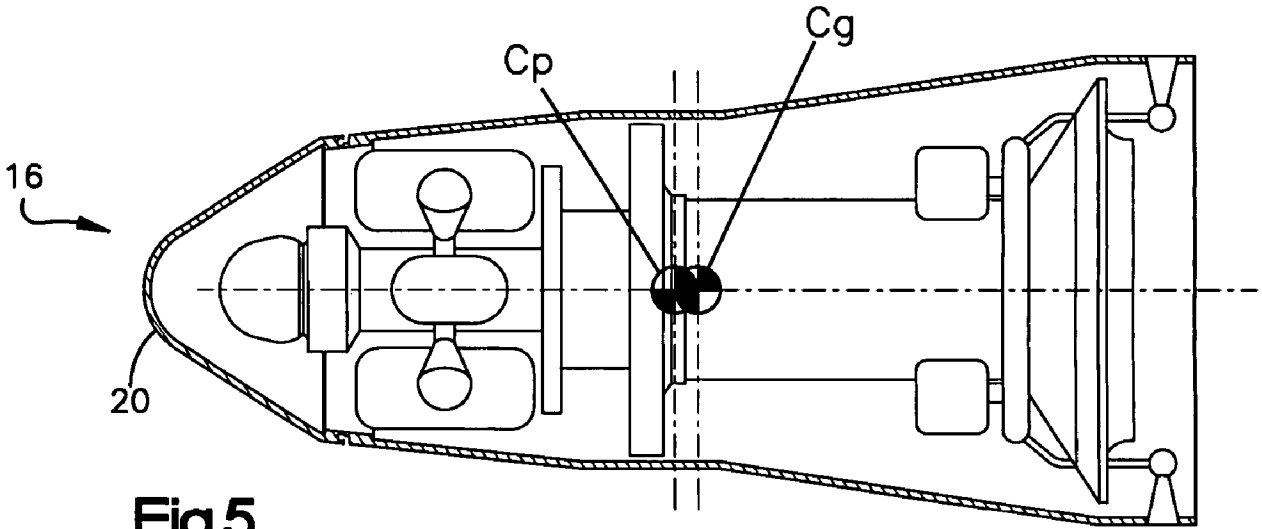

With reference now to FIGS. 4 and 5, another advantage of the multi-nosecone missile 10 is illustrated. As shown in FIG. 4, when the outer nosecone 18 is still attached to the rest of the payload assembly 16, the center of pressure ($C_p$) of the payload assembly 16 is well forward of the center of gravity ($C_g$). This is not a concern as long as the second stage 14 of the missile is still attached to the payload assembly 16, since the missile 10 is under powered flight while the second stage 14 is still attached, and since the second stage 14 pulls the $C_p$ and $C_g$ well aft of the payload assembly 16. However, once the second stage 14 is detached from the payload assembly 16, having the $C_p$ well forward of the $C_g$ becomes a liability. Such a configuration is less stable than when the $C_p$ and the $C_g$ are close together, in that aerodynamic forces tend to divert the payload assembly 16 from its course. As a result, greater intervention of an attitude control system is required in order to maintain the desired course. In contrast, if the outer nosecone 18 is jettisoned, the $C_p$ is moved aft, closer to the $C_g$, without significantly changing the location of the $C_g$. This is because the outer nosecone 18 provides a relatively large surface area (significantly affecting the location of $C_p$) while having a relatively light weight (having less effect on $C_g$). Thus, by deploying (separating or detaching) the outer nosecone 18, the $C_p$ and $C_g$ are moved much closer together. Advantageously, the time required for operation of the ACS 32, in order to maintain the desired course, may be significantly reduced. As another advantage, the design requirements for the ACS 32 may be reduced, thus allowing an attitude control system with less weight to be employed. Indeed, in some instances it may be possible or desirable to dispense with use of an attitude control system entirely.

It will be appreciated, then, that the payload assembly 16, with its two separate nosecones 18 and 20, allows for desirable drag and thermal characteristics in low-altitude flight, while enabling better maneuverability, with less reliance on an attitude control system, in higher-altitude flight. Such a system may increase performance at reduced costs. Such performance increases may include, for example, reduced weight, reduced cost, faster time from launch to target impact, and/or improved reliability.

Figure 6:
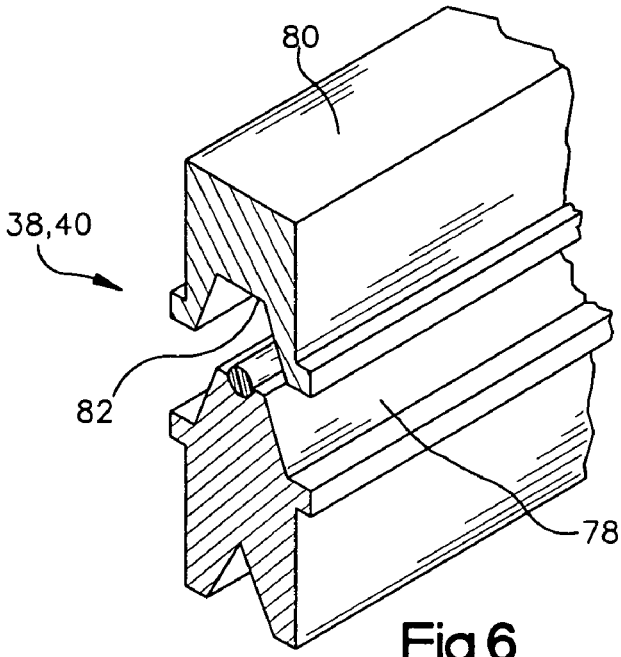
FIG. 6 is a view showing details on one embodiment of a tongue-and-groove joint of the outer nosecone in accordance with the missile of FIG. 1.

With reference now to FIG. 6, details are shown of the gasketed tongue-and-groove seal between the portions 38 and 40 of the outer nosecone 18. One of the portions 38, 40 may include a gasket having a protruding tongue portion 78, while the other of the portions 38, 40 may include a grooved portion 80 having a groove 82 therein, configured to receive the tongue 78. When the tongue 78 is pressed into the groove 82, a seal is made, sufficient to prevent ingress of hot gases into the interior of the outer nosecone 18. The overlap in the seal may prevent electromagnetic shielding leakage between the portions 38 and 40. The gasket material may include any of a variety of suitable materials, such as silicone-based rubber, neoprene, and fluorosilicone materials.

Figure 7:
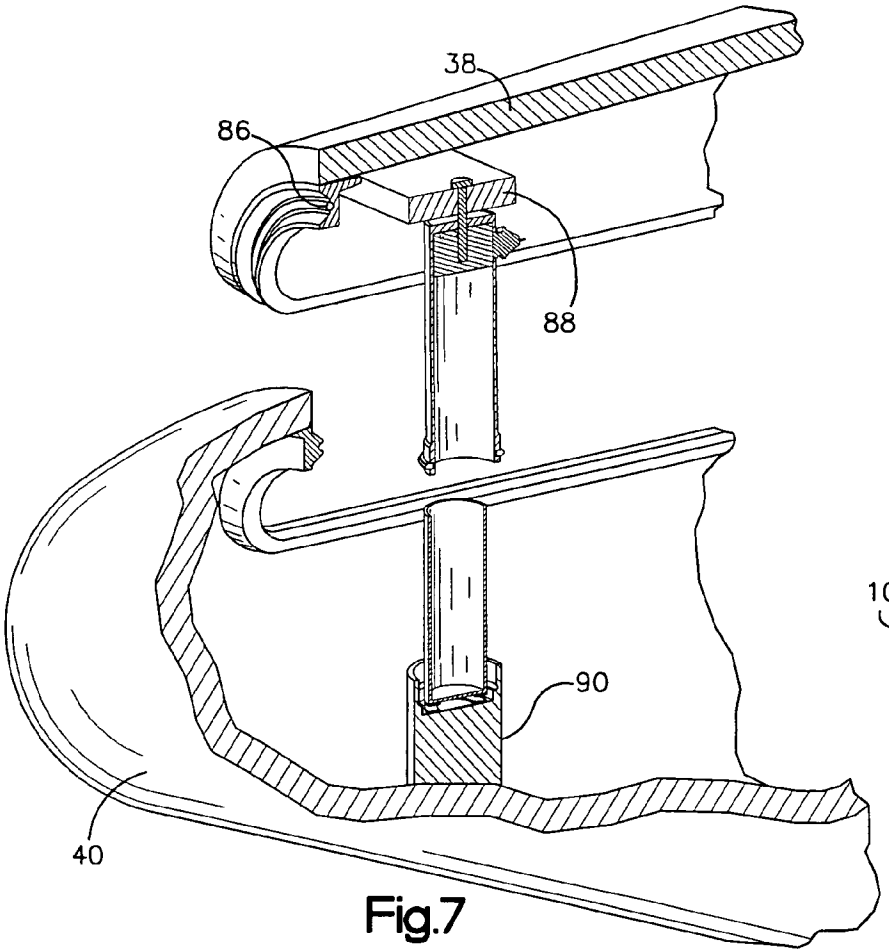
FIG. 7 shows an exploded view of a portion of the outer nosecone of FIG. 1.

Turning now to FIG. 7, another mechanism for sealing the petals 38 and 40 is shown. As shown in FIG. 7, an O-ring 86 is provided in a groove between portions of the petals 38 and 40. The O-ring 86 provides a sufficient seal for the outer nosecone 18. The O-ring may include suitable materials, such as the gasket materials listed above.

Figure 8:
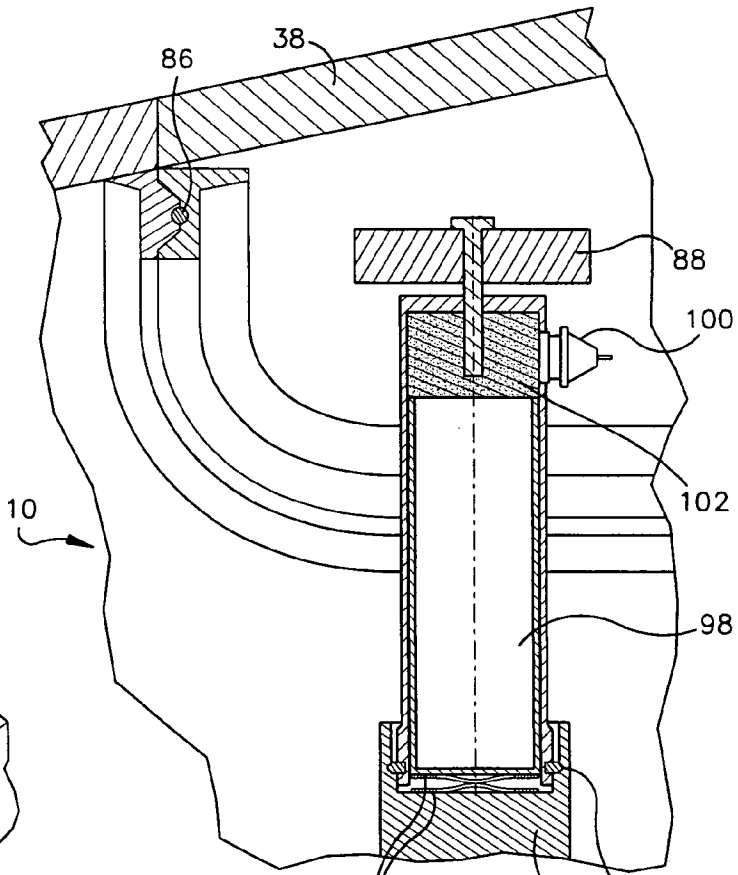
FIG. 8 shows a side sectional view of a portion of the outer nosecone.

With reference now in addition to FIG. 8, details of the mounting of the piston actuator 54 are shown. As noted above, the piston actuator 54 is a pyrotechnic device for initiating separation of the outer nosecone petals 38 and 40. The outer cone petals 38 and 40 may include respective mounting housings 88 and 90 for containing the piston actuator 54. The piston actuator 54 may be coupled to the petal 40, with, for example, a detent pin or ring 92 locked into spring washers 94 that are part of the petal 40. The detent pins 92 and the spring washers 94 maintain the position of a piston 98 of the piston actuator 54, relative to the outer cone petal 40. A separator initiator 100 ignites a pyrotechnic powder or material 102 to cause a rise in pressure which pushes the piston 98, and thus the petal 40, away from the petal 38. This causes the outer cone 18 to deploy (separate or detach from the rest of the nosecone 16).

It will be appreciated that the piston actuator 54 may be augmented or replaced by any of a variety of separation initiators for separating outer cone petals 38 and 40 from the housing 46.

Figure 9:
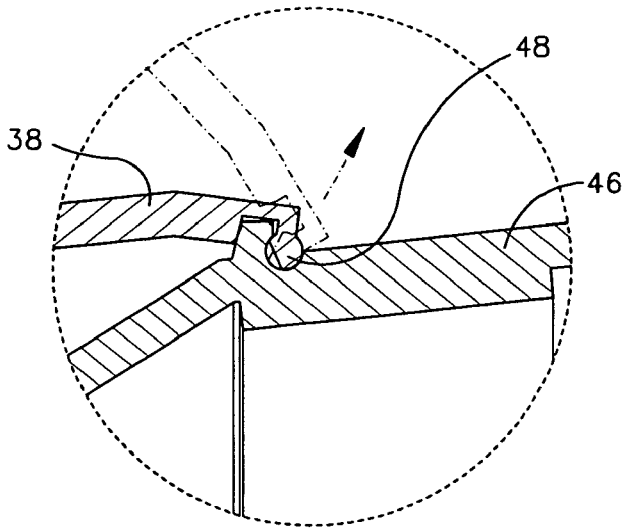
FIG. 9 shows a detailed view of one embodiment of a hinge assembly for the outer nosecone.

FIG. 9 shows details of the hinge coupling 48 between the outer cone petal 38 and the housing 46. The hinge coupling 48 allows rotation of the outer cone petal 38 relative to the housing 46, followed by detachment of the outer cone petal 38 from the housing 46. This detachment process is illustrated in FIGS. 10–12.

Figure 10:
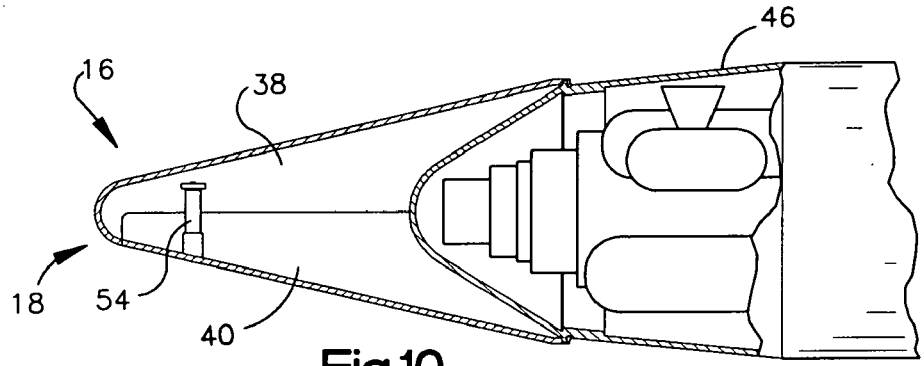
FIG. 10 shows a side sectional view of one step in the separation of the outer nosecone.

In FIG. 10 the outer cone 18 is shown just prior to actuation of the piston actuator 54. The outer cone petals 38 and 40 are coupled together, and coupled to the housing 46.

Figure 11:
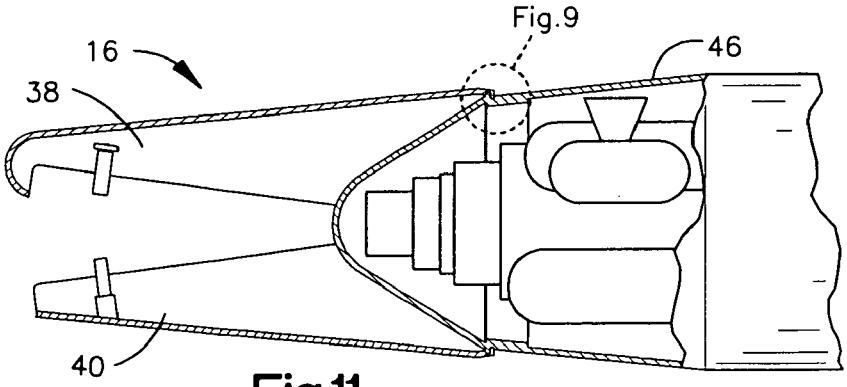
FIG. 11 shows a side sectional view of a second step in the separation of the outer nosecone.
Figure 12:
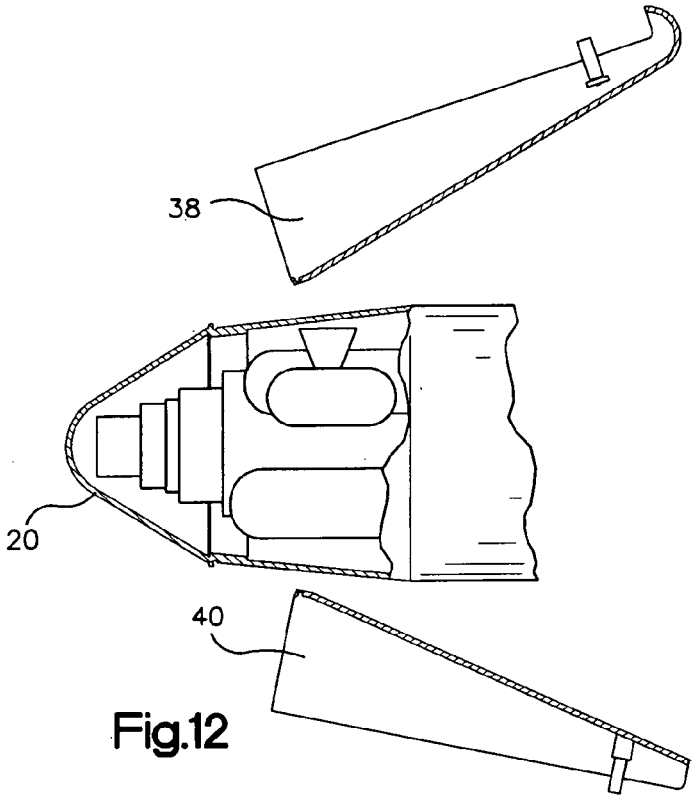
FIG. 12 shows a third step in the separation of the outer nosecone.

Upon initiation by the piston actuator 54, illustrated in FIG. 11, the outer cone petals 38 and 40 are driven away from one another and rotated relative to the housing 46 and the inner cone 20. The separation process may be initiated at a predetermined time after launch of the missile 10. Alternatively, the separation initiation may be initiated by activating the separation initiator (such as the piston actuator 54) upon a signal from the control system, for example, in the payload 22. As noted above, upon initiation, the pyrotechnic material 102 of the piston actuator 54 ignites or explodes, causing a pressure rise that pushes the outer cone petals 38 and 40 apart from one another.

As the outer cone petals 38 and 40 separate from one another, aerodynamic forces on the petals 38 and 40 cause further separation. Eventually, as illustrated in FIG. 12, the petals 38 and 40 separate altogether from the payload assembly 16.

The piston actuator 54 is located in the forward half of the outer nosecone 18. This location for the piston actuator 54 advantageously reduces shock loads due to the actuation of the piston actuator 54. In order for shock loads from the piston actuator 54 to reach the payload 22 (and for example, sensitive devices of the payload 22 such as the seeker 26), the loads from the piston actuator 54 must traverse the entire length of at least the aft half of the outer nosecone 18, and be transmitted through the hinge couplings 48 and 50, prior to separation (detachment) of the outer nosecone petals 38 and 40. Due to the rapid separation of the outer nosecone petals 38 and 40, no significant shock from the actuation from the piston actuator 54 is transmitted to the remaining parts of the payload assembly 16. In particular, no significant shock is transmitted to the payload 22. Thus, by placement of the piston actuator 54 in the forward half of the outer nosecone 18, the outer nosecone 18 may be detached from the remainder of the payload assembly 16 without imparting undesirable shocks to the payload 22.

Figure 13:
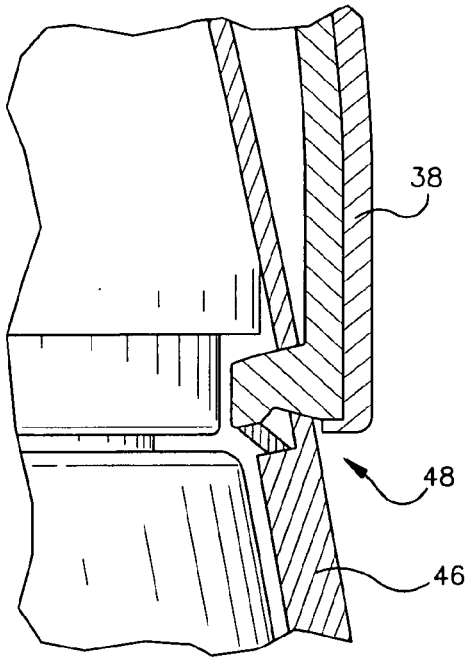
FIG. 13 shows a side sectional view of an alternative embodiment of the hinge connection of the outer nosecone.

FIG. 13 shows an alternative configuration for the hinge coupling 48.

It will be appreciated that the hinge couplings shown in FIG. 9 and FIG. 13 may be substantially the same for the hinge couplings on both sides of the outer nosecone 18.

Figure 14:
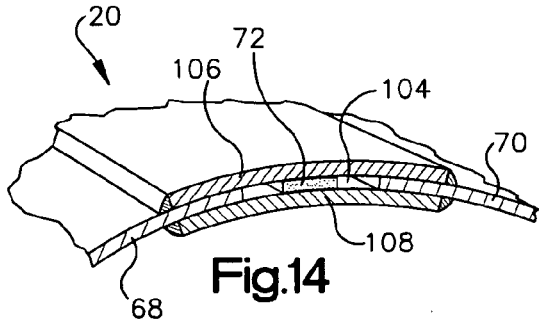
FIG. 14 shows a cutaway view showing detail of placement of a mild detonating charge for deployment of the inner nosecone.

FIG. 14 shows detail of an example of the placement of detonating charge 72 (FIG. 2). The part of the detonating charge 72 shown in FIG. 14 is located in a cavity 104 between the nosecone portions 68 and 70 of the inner nosecone 20. Aluminum doubler plates 106 and 108 enclose the cavity 104. Sealing components or bond layers are applied between the doubler plates and the nosecone portions upon riveting or fastening, to provide sealing for the inner nosecone 20. Upon ignition, the detonating charge 72 breaks the double plates 106 and 108, allowing the nosecone portions 68 and 70 to separate from one another and from the housing 46 (FIG. 2).

Figure 15:
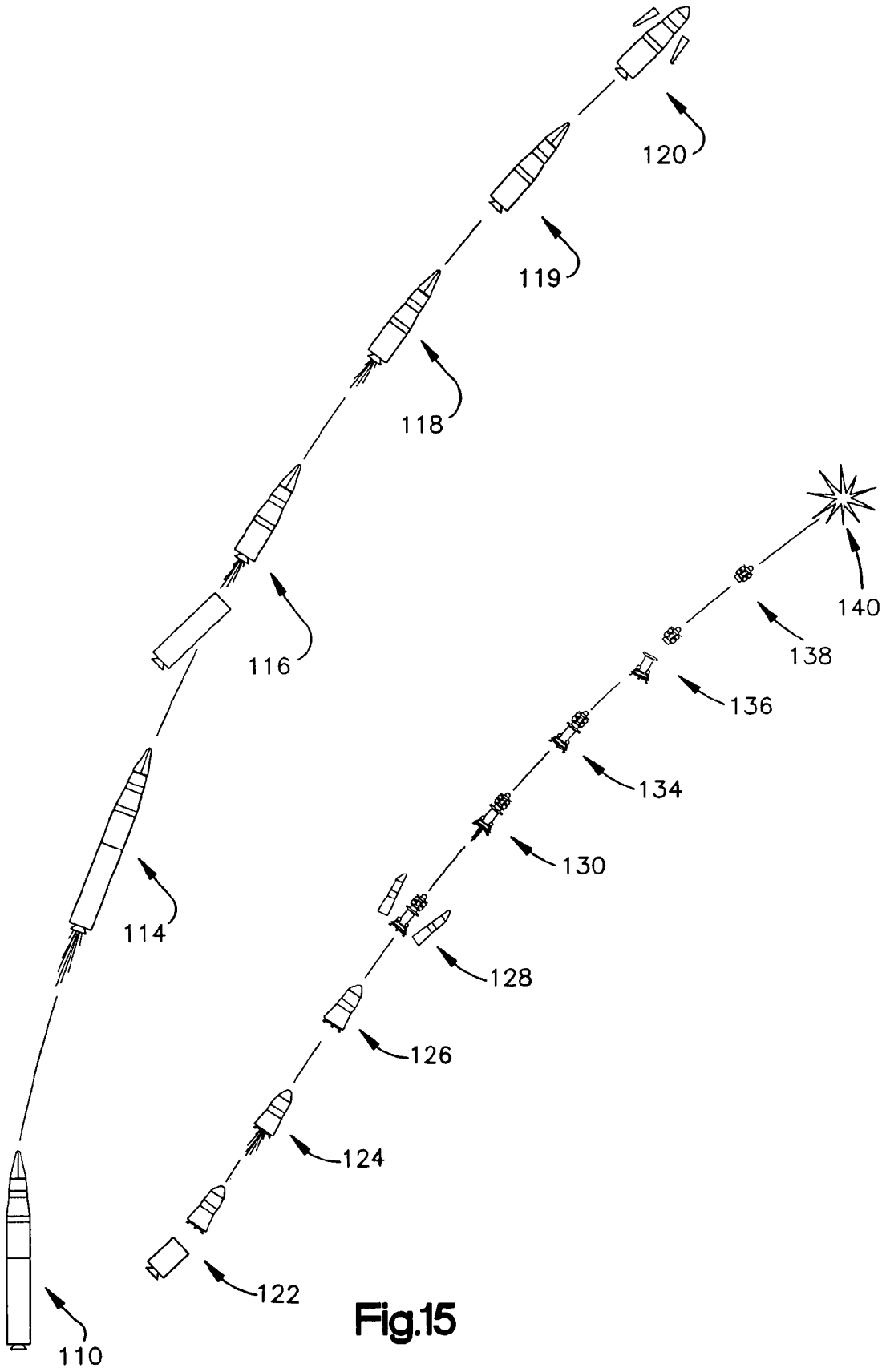
FIG. 15 illustrates the various steps in the operation of the missile.

FIG. 15 shows by illustration various steps of a timeline of events from the launch of the missile 10 to the interception of the target by the impact or intercept projectile 28. At step 110 in FIG. 14, the first stage of the missile 10 is ignited. In step 114 the thrust provided by the first stage 12 boosts the missile 10, greatly accelerating the missile 10. In step 116, separation of the first stage 12 occurs, as does ignition of the second stage 14. Step 118 illustrates second stage boost.

In step 119 the second stage has substantially exhausted its fuel. Then, in step 120, outer nosecone 18 now ejects (separates, detaches, deploys) from the remainder of the missile 10. The step 120 may occur at an altitude of at least about 50 km. At this point, the near-earth atmosphere has been passed out of, and the need for a low-drag, high-thermal-resistant nosecone has been superceded by the need for a payload assembly that has a $C_p$ close to its $C_g$, enabling it to maintain its course without a large degree of correction from an attitude control system.

In step 122, the second stage 14 separates from the payload assembly 16, and in step 124 the rocket motor 30 of the payload assembly 16 ignites. In step 126, the payload assembly 16 coasts. The burn in step 124 and the coasting in step 126 may be intermittent events, with, for example, the burn occurring for two to ten seconds, followed by a period of coasting. During both the steps 124 and 126 the attitude control system 32 may be guiding the payload assembly 16 towards its intended target.

In step 128 the inner nosecone 20 may be deployed (separated or detached). The separation of the inner nosecone 20 may be accomplished by detonation of the detonating charge 72 (FIG. 2). It will be appreciated that the inner nosecone 20 has a reduced area and a reduced volume when compared to the outer nosecone 18. Therefore, it will be appreciated that the shock due to the detonation of the inner nosecone 20 will be reduced, compared to the shock that would be required to result from the detonation of a streamlined nosecone, such as the outer nosecone 18. Thus, early separation of the outer nosecone 18 may allow detonation of only a reduced-weight inner nosecone 20, thereby reducing the weight associated with the pyrotechnic shock of the detonating charge 72, and thereby reducing the shock loading on the payload 22, including the loading on the sensor 26. The separation of the inner nosecone 20 may occur at, for example, a minimum of about 90 km.

In step 130, the third stage rocket motor 30 may be ignited to provide further thrust to what remains of the payload assembly 16. The ACS 32 may provide appropriate attitude control during the further thrusting of the rocket motor 30. It will be appreciated that, above a certain level, the inner nosecone 20 may no longer be required to provide protection to the payload 22 of the payload assembly 16. That is, above a certain altitude, the atmosphere may be thin enough so that no nosecone is necessary. In step 134, a guided coast of the remaining parts of the payload assembly 16 may be accomplished, with guidance provided by appropriate actuation of the attitude control system 32.

In step 136 the impact projectile is separated from the remaining portions of the actuation control system 16, with the impact projectile proceeding in controlled flight in step 138. Finally, in step 140 the impact projectile 28 intercepts the target, bringing a successful end to the operation of the missile 10.

In jettisoning of the first nosecone or outer nosecone 18, it may be appreciated that the outer nosecone 18 may be jettisoned before any shock load due to operation of the piston actuator 54 has had time to be transmitted to the inner nosecone 20 and/or the housing 46.

The jettisoning of the outer nosecone 18 has been described above as occurring at approximately 50 km. However, it will be appreciated that the jettisoning of the first nosecone 18 may occur at other altitudes, for example, occurring at about 40 km. Thus, the missile 10 may be able to initiate interception maneuvers at a shallower altitude, for example, about 40 km, than previous missiles. This lower altitude of initiation of interception maneuvers may occur without an undesirable penalty in terms of attitude control system weight.

It will be appreciated that the missile 10 may involve significant advantages other than those mentioned above. For example, there may be an advantage to jettisoning parasitic weight of the outer nosecone 18 prior to maneuvering. In addition, the outer nosecone 18 may be jettisoned at a relatively low altitude, thereby reducing problems of high-altitude space debris caused by the later jettisoning of the outer nosecone 18.

With use of the payload assembly 16 with its multiple nosecones 18 and 20, the missile 10 may be much quicker, faster, and more capable of intercepting fast-moving targets that accelerate above 90 km altitude. This may greatly increase the launch area denied performance and the overall utilization of a weapon system utilizing the missile 10. By utilizing the payload assembly 16 with the multiple nosecones 18 and 20, a substantial decrease in payload weight, cost, and performance risks may be obtained, while substantially increasing interceptor performance.

Figure 16:
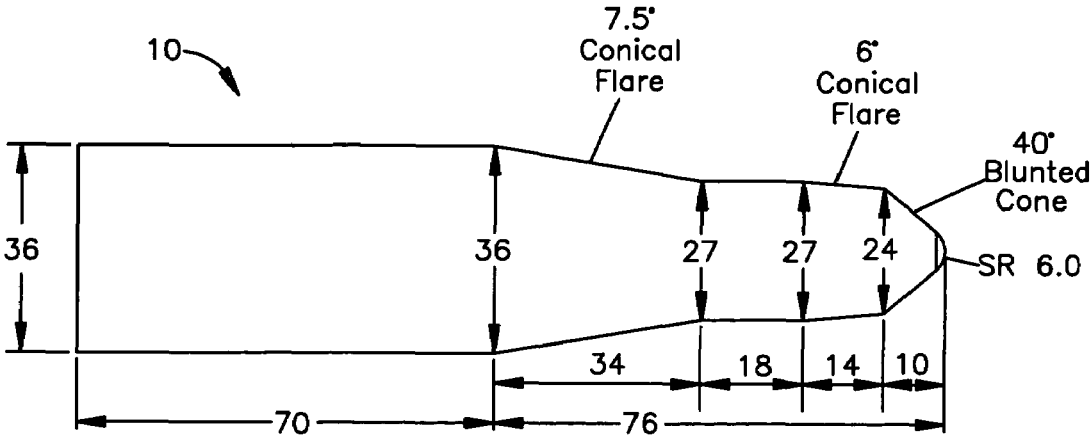
FIG. 16 illustrates dimensions of specific embodiment missile in accordance with the present invention, in its second stage configuration.
Figure 17:
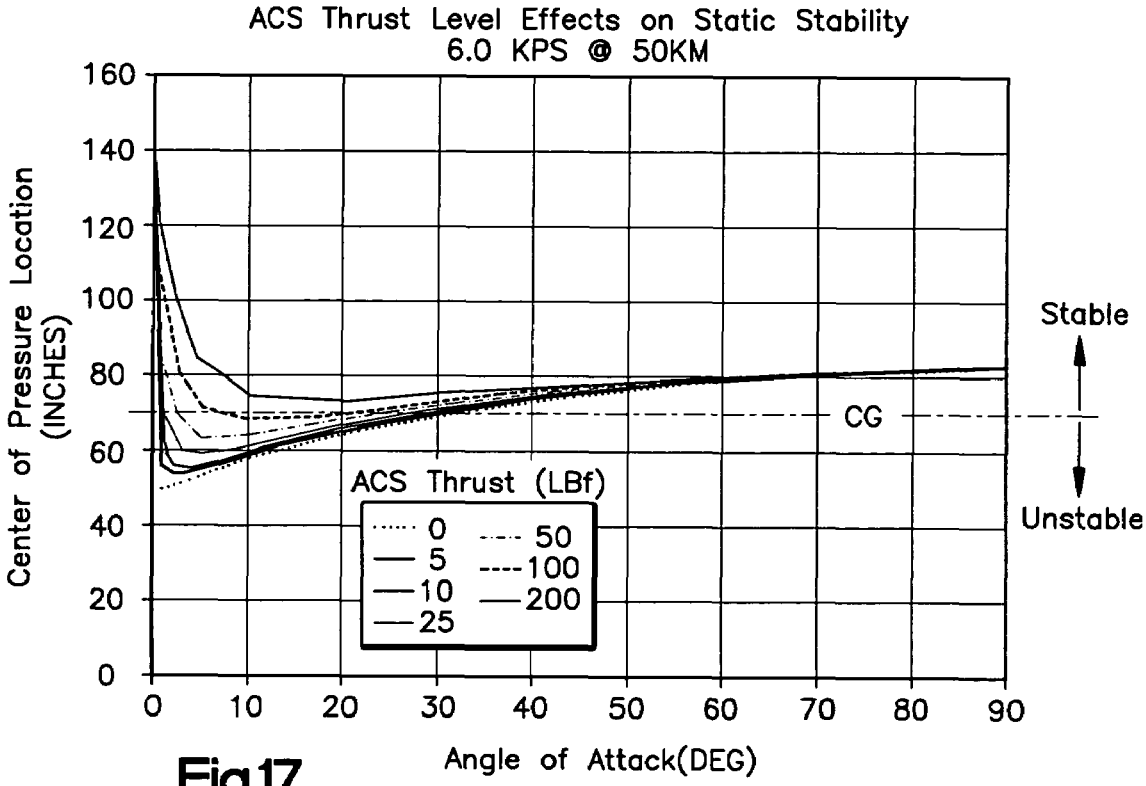
FIG. 17 is a graph showing stability (positions of the center pressure and the center of gravity) of the missile of FIG. 16 as a function of thrust and angle of attack, for an altitude of 50 km.
Figure 18:
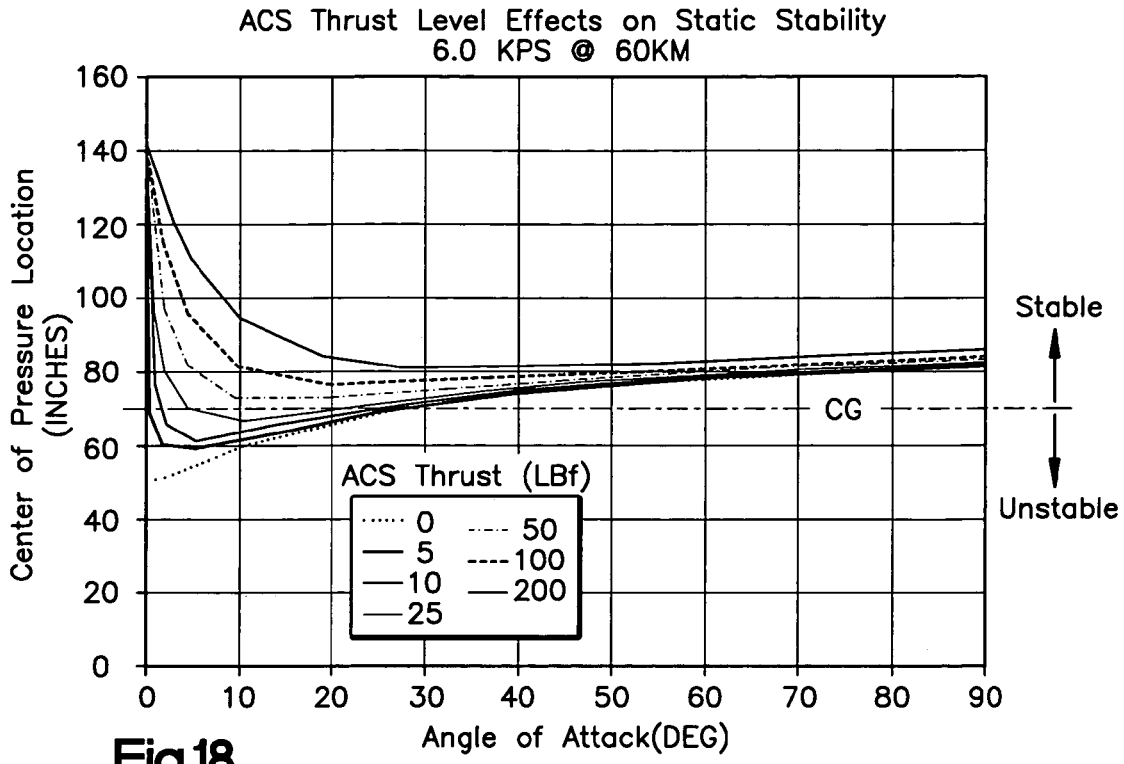
FIG. 18 is a graph showing stability (positions of the center pressure and the center of gravity) of the missile of FIG. 16 as a function of thrust and angle of attack, for an altitude of 60 km.
Figure 19:
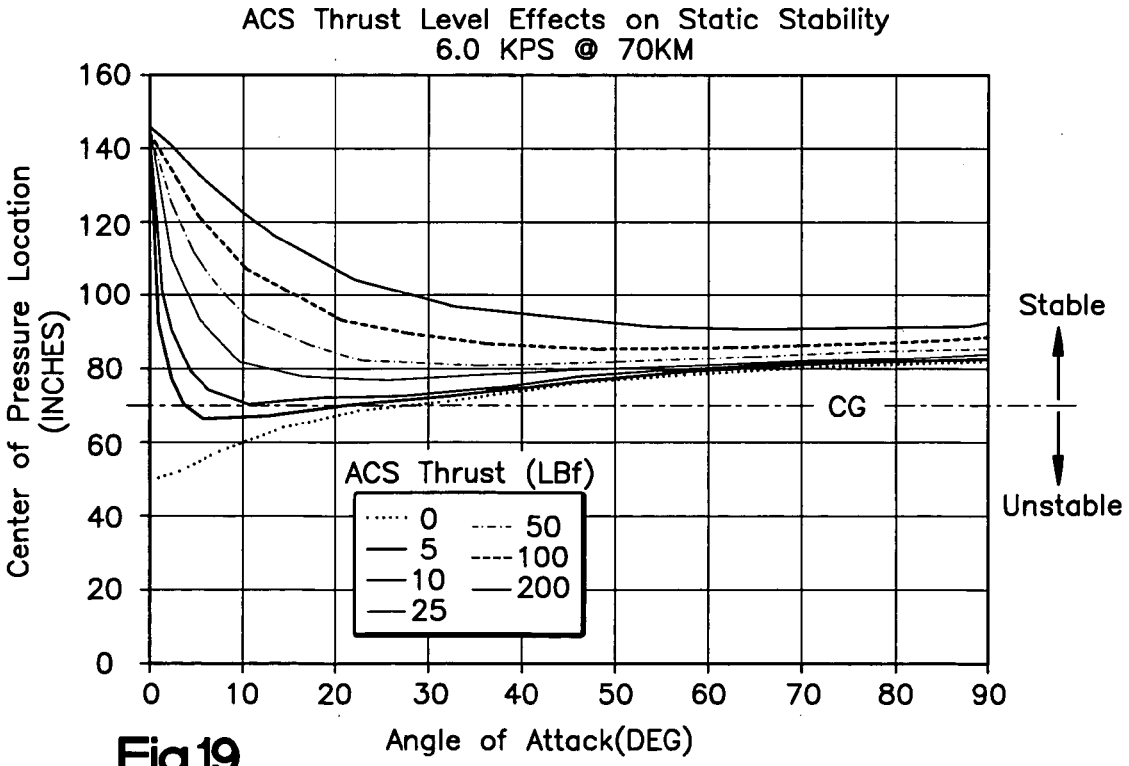
FIG. 19 is a graph showing stability (positions of the center pressure and the center of gravity) of the missile of FIG. 16 as a function of thrust and angle of attack, for an altitude of 70 km.

FIG. 16 shows dimensions of one specific configuration of the missile 10 in its second stage configuration, corresponding to steps 118 and 119 of FIG. 14 (with dimensions given inches). FIGS. 17–19 plots positions of the center pressure and the center of gravity of this configuration as a function of thrust level and angle of attack for three altitudes, 50 km, 60 km, and 70 km, showing the stability of this configuration.

Figure 20:
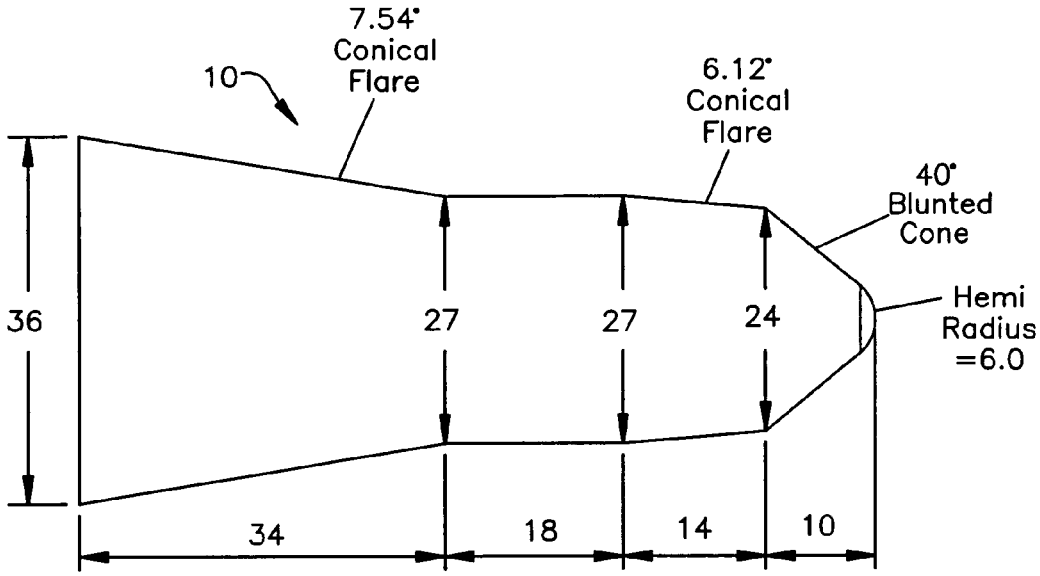
FIG. 20 illustrates dimensions of a specific embodiment missile in accordance with the present invention, in its second stage configuration.
Figure 21:
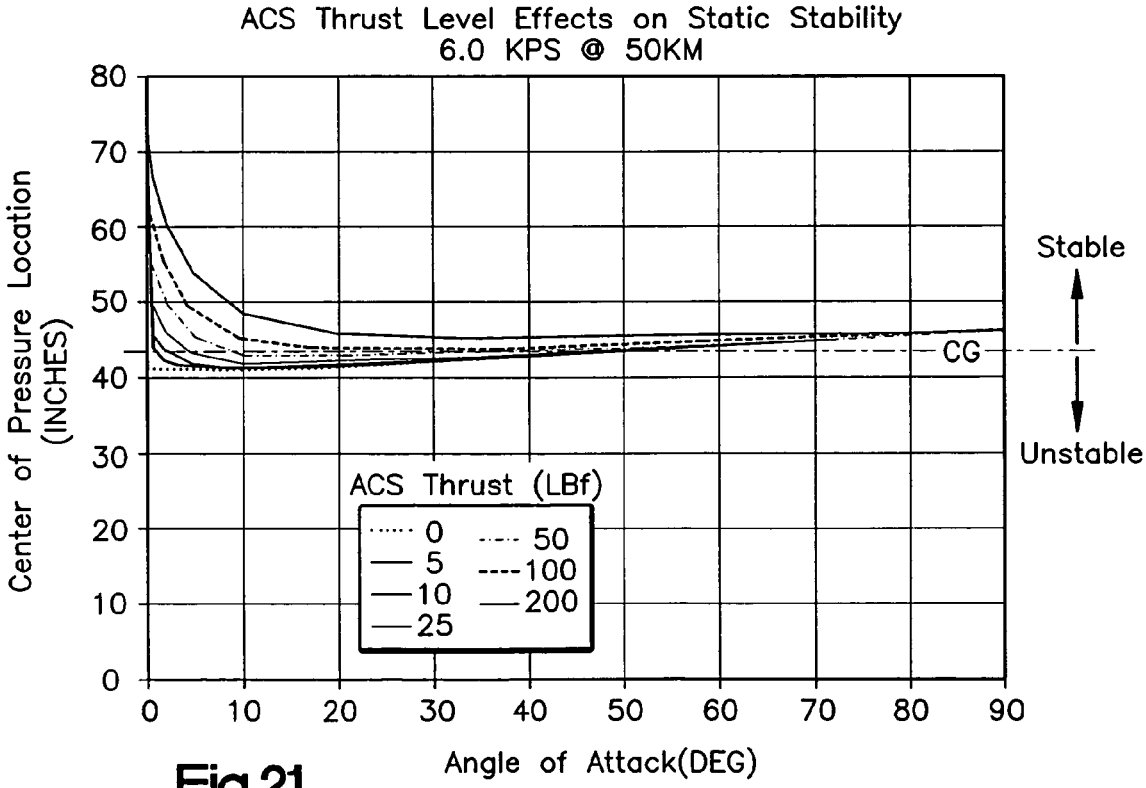
FIG. 21 is a graph showing stability (positions of the center pressure and the center of gravity) of the missile of FIG. 20 as a function of thrust and angle of attack, for an altitude of 50 km.
Figure 22:
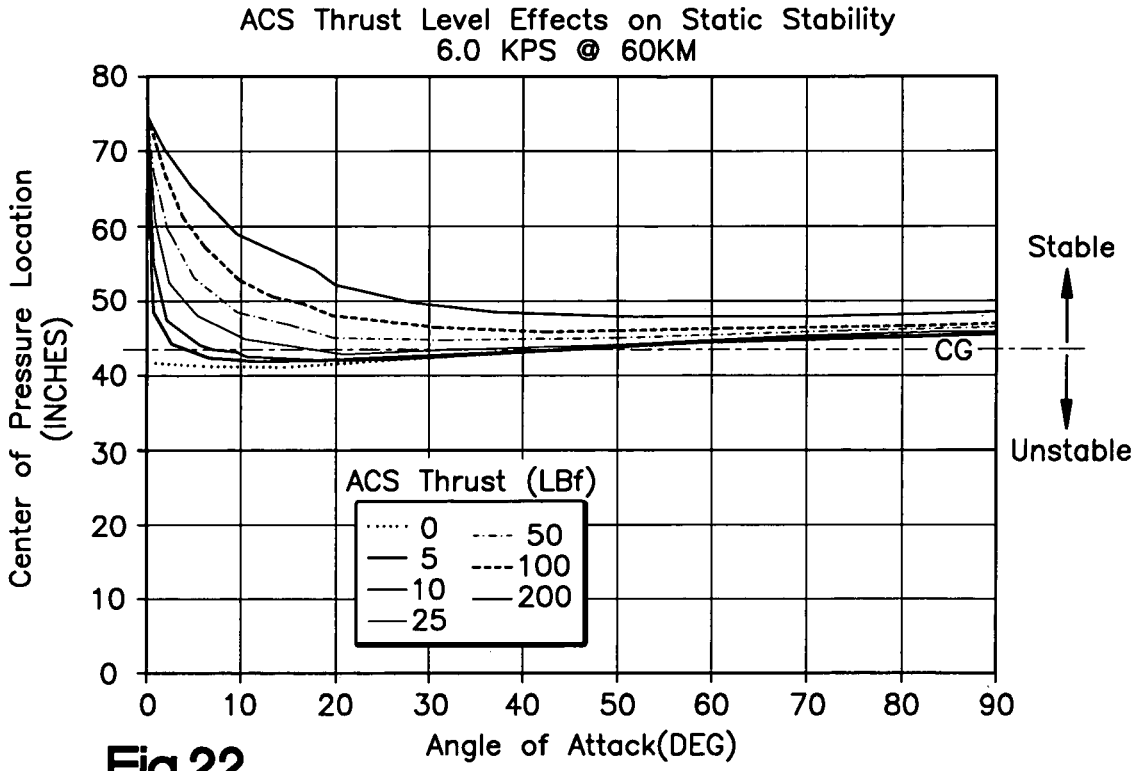
FIG. 22 is a graph showing stability (positions of the center pressure and the center of gravity) of the missile of FIG. 20 as a function of thrust and angle of attack, for an altitude of 60 km.
Figure 23:
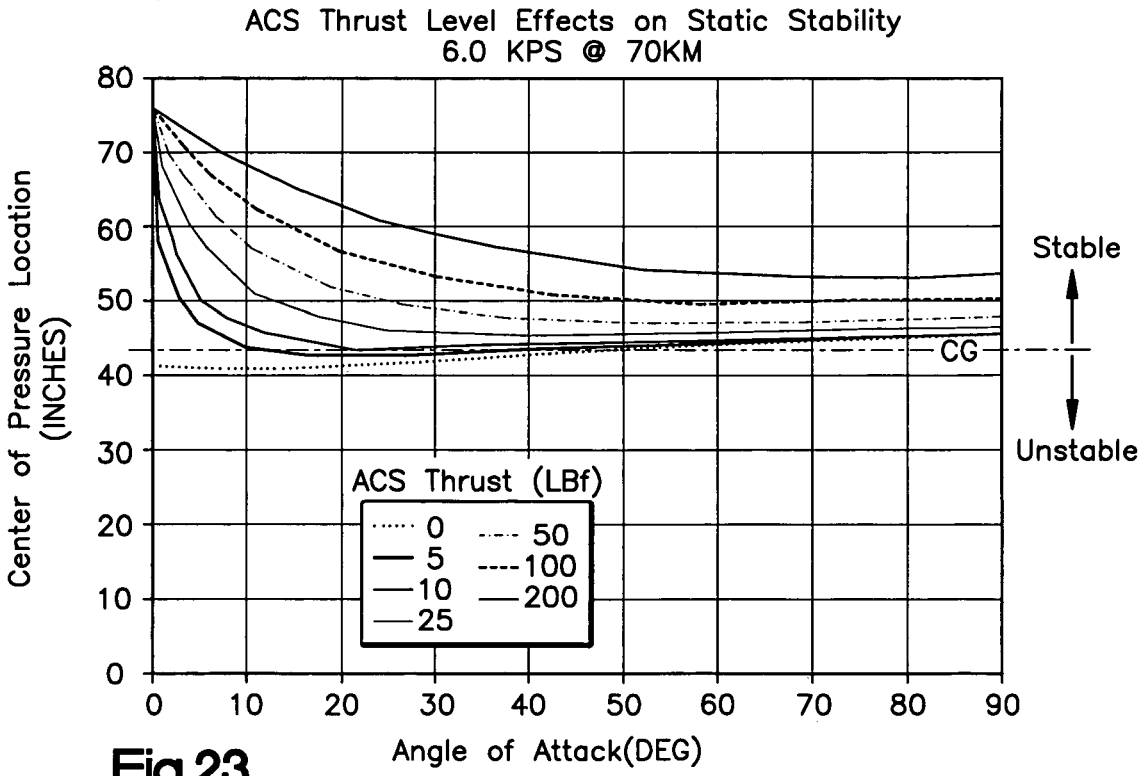
FIG. 23 is a graph showing stability (positions of the center pressure and the center of gravity) of the missile of FIG. 20 as a function of thrust and angle of attack, for an altitude of 70 km.

FIG. 20 shows dimensions of the same missile in its third stage configuration, corresponding to steps 122 and 126 of FIG. 15. FIGS. 21–23 plot positions of the center pressure and the center of gravity of this configuration as a function of thrust level and angle of attack for three altitudes, 50 km, 60 km, and 70 km. As is evident from the plots in FIG. 21-23, this configuration is stable for a large range of angles of attack, even when no thrust is applied.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile comprising:

a payload assembly; and one or more booster stages separably coupled to the payload assembly;

wherein the payload assembly includes at least two nosecones;

wherein the nosecones are each configured to separate from the payload assembly during flight of the missile;

wherein the at least two nosecones include an outer nosecone and an inner nosecone;

wherein the inner nosecone is located at least partially within the payload assembly, internal to the outer nosecone; and wherein the outer nosecone has a more streamlined shape than the inner nosecone, the outer nosecone thereby having a lower coefficient of drag than the inner nosecone.

2. The missile of claim 1, wherein the outer nosecone has a sharper cone angle than the inner nosecone.

3. The missile of claim 1, wherein the outer nosecone has a substantially straight outer nosecone external surface portion with an outer nosecone angle of between about 5 degrees and about 10 degrees relative to a longitudinal axis of the missile.

4. The missile of claim 3, wherein the inner nosecone has a substantially straight inner nosecone external surface portion with an inner nosecone angle of between about 30 degrees and about 50 degrees relative to the longitudinal axis of the missile.

5. The missile of claim 1, wherein the outer nosecone has a different separation mechanism from that of the inner nosecone.

6. The missile of claim 1, wherein the outer nosecone includes outer nosecone petals that are configured to hingedly rotate and separate from the payload assembly.

7. The missile of claim 6, wherein the payload assembly includes a piston actuator coupled to the outer nosecone petals, for initiating separation of the outer nosecone petals.

8. The missile of claim 7, wherein the piston actuator is in a forward half of the outer nosecone.

9. The missile of claim 6, wherein the inner nosecone includes inner nosecone petals and a detonating charge for destroying the integrity of the inner nosecone petals.

10. A missile comprising:

a payload assembly; and one or more booster stages separably coupled to the payload assembly;

wherein the payload assembly includes at least two nosecones;

wherein the at least two nosecones include an outer nosecone and an inner nosecone;

wherein the inner nosecone is located at least partially within the payload assembly, internal to the outer nosecone;

wherein the outer nosecone includes outer nosecone petals that are configured to hingedly rotate and separate from the payload assembly;

wherein the inner nosecone includes inner nosecone petals and a detonating charge for destroying the integrity of the inner nosecone petals; and wherein the inner nosecone petals are hermetically sealed with one another prior to detonation of the detonating charge.

11. The missile of claim 1, wherein the outer nosecone includes outer nosecone petals made of a composite material that is configured to ablate during hypersonic ascent through air, to thereby provide thermal protection for the outer nosecone.

12. The missile of claim 11, wherein the inner nosecone includes inner nosecone petals made of aluminum.

13. The missile of claim 3, wherein the payload assembly includes an attitude control system.

14. The missile of claim 13, wherein the payload assembly also includes a rocket motor.

15. A method of operating a missile during flight, the method comprising:

exposing to atmosphere, during a first phase of the flight, an outer nosecone of a payload assembly of the missile;

separating the outer nosecone from the payload assembly following the first phase of the flight, thereby exposing an inner nosecone of the payload assembly; and continuing flight of the missile during a second phase of the flight;

wherein the inner nosecone includes inner nosecone petals that remain hermetically sealed throughout at least a part of the second phase of the flight.

16. The method of claim 15, wherein the first phase is a relatively low-altitude phase, at a lower altitude than the second phase.

17. The method of claim 16, wherein the first phase of the flight includes substantially all of the flight at an altitude of up to about 30 km.

18. The method of claim 16, wherein the first phase includes boosting of the missile by one or more boost stages of the missile, which are separably coupled to the payload assembly.

19. The method of claim 15, wherein the continuing flight includes maneuvering the missile toward a target.

20. The method of claim 19, wherein the maneuvering includes maneuvering the missile toward a moving target.

21. The method of claim 15, wherein the separating occurs during a coast portion of the flight, after firing of a booster stage coupled to the payload assembly ceases and before separation of the booster stage.

22. The method of claim 15, wherein the separating includes:

hingedly rotating outer nosecone petals of the nosecone; and using aerodynamic forces to separate the outer nosecone petals from the payload assembly.

23. The method of claim 22, wherein the hingedly rotating is initiated by actuation of a piston actuator in a forward half of the outer nosecone, wherein the actuation of the piston actuator pushes the outer nosecone petals apart from one another.

24. A method of operating a missile during flight, the method comprising:

exposing to atmosphere, during a first phase of the flight, an outer nosecone of a payload assembly of the missile;

separating the outer nosecone from the payload assembly following the first phase of the flight, thereby exposing an inner nosecone of the payload assembly; and continuing flight of the missile during a second phase of the flight;

separating the inner nosecone from the payload assembly at completion of the second phase of the flight, wherein the second chase of the flight is completed at an altitude of at least about 90 km.

25. The method of claim 24, wherein the first phase is a relatively low-altitude phase, at a lower altitude than the second phase.

26. The method of claim 25, wherein the first phase of the flight includes substantially all of the flight at an altitude of up to about 50 km.

27. The method of claim 25, wherein the first phase includes boosting of the missile by one or more boost stages of the missile, which are separably coupled to the payload assembly.

28. The method of claim 24, wherein the continuing flight includes maneuvering the missile toward a target.

29. The method of claim 28, wherein the maneuvering includes maneuvering the missile toward a moving target.

30. The method of claim 24, wherein the separating occurs during a coast portion of the flight, after firing of a booster stage coupled to the payload assembly ceases and before separation of the booster stage.

31. The method of claim 24, wherein the separating includes:

hingedly rotating outer nosecone petals of the nosecone; and using aerodynamic forces to separate the outer nosecone petals from the payload assembly.

32. The method of claim 31, wherein the hingedly rotating is initiated by actuation of a piston actuator in a forward half of the outer nosecone, wherein the actuation of the piston actuator pushes the outer nosecone petals apart from one another.

33. The missile of claim 10, wherein the nosecones are configured to separate from the payload assembly during flight of the missile.

* * * * *